United States Patent [19]

Blake

[11] Patent Number: 4,895,008

[45] Date of Patent: Jan. 23, 1990

[54] SECURITY SYSTEM

[76] Inventor: David C. Blake, 264 Geelong Rd., West Footscray, Victoria, 3012, Australia

[21] Appl. No.: 135,030

[22] PCT Filed: Jan. 21, 1987

[86] PCT No.: PCT/AU87/00014

§ 371 Date: Sep. 21, 1987

§ 102(e) Date: Sep. 21, 1987

[87] PCT Pub. No.: WO87/04481

PCT Pub. Date: Jul. 30, 1987

[30] Foreign Application Priority Data

Jan. 23, 1986 [AU] Australia ..... PH04313
Aug. 6, 1986 [AU] Australia ..... PH07350

[51] Int. Cl.[4] ..... E05B 65/46

[52] U.S. Cl. ..... 70/86; 70/277; 109/47; 312/319

[58] Field of Search ..... 70/85-88, 70/277-279, 283-285, 150; 292/201, 216, 111, 127, 129, 135; 109/47; 312/319, 333

[56] References Cited

U.S. PATENT DOCUMENTS

| | | | |
|---|---|---|---|
| 1,548,123 | 8/1925 | Dunning et al. | 70/88 |
| 1,926,809 | 9/1933 | Jacobson | 70/88 |
| 2,034,589 | 3/1936 | Meilink | 70/85 |
| 2,145,314 | 1/1939 | Murtaugh, Jr. | 109/47 |
| 2,517,175 | 8/1950 | Bremer | 109/47 |
| 3,089,329 | 5/1963 | Kerr | 70/86 X |
| 3,543,547 | 12/1970 | Sugiyama | 70/277 |
| 3,592,521 | 7/1971 | Cox | 312/333 |
| 3,774,422 | 11/1973 | Hogan et al. | 70/277 X |
| 4,155,610 | 5/1979 | Englund | 312/319 |
| 4,268,076 | 5/1981 | Itoi | 70/87 X |
| 4,522,047 | 6/1985 | Johl | 70/278 X |
| 4,656,852 | 4/1987 | Deschamps | 70/277 |
| 4,660,900 | 4/1987 | Paterlini | 312/319 X |
| 4,669,394 | 6/1987 | Fogleman et al. | 70/278 X |

FOREIGN PATENT DOCUMENTS

| | | |
|---|---|---|
| 215767 | 11/1908 | Fed. Rep. of Germany . |
| 2330089 | 5/1977 | France . |
| 2422798 | 11/1979 | France . |
| 1400006 | 7/1975 | United Kingdom . |
| 1582099 | 12/1980 | United Kingdom . |

OTHER PUBLICATIONS

"Adjustable Profile Latch," W. W. Stokes, Jr., IBM Technical Disclosure Bulletin, vol. 21, No. 10, Mar. 1979, pp. 4144 and 4145.

*Primary Examiner*—Gary L. Smith
*Assistant Examiner*—Suzanne L. Dino
*Attorney, Agent, or Firm*—Fleit, Jacobson, Cohn, Price, Holman & Stern

[57] ABSTRACT

A lockable security system, preferably a security drawer system (10), which uses an electronic combination lock (62, 64, 66) to control opening of the drawer (12). The invention includes a cam (80, 106) which co-operates with locking pin (86, 134) to prevent unauthorized access.

5 Claims, 8 Drawing Sheets

SECURITY SYSTEM

The present invention relates to a lockable security system and relates particularly, although not exclusively, to a lockable security drawer system.

It is one object of the present invention to provide a lockable drawer system which is easy to operate and can provide secure safekeeping of cash and valuables.

With this object in view the present invention may provide in one aspect a lockable security system including at least one member movable between open and closed positions and adapted to engage a support means and an electronic combination lock adapted to be connected, directly or indirectly, to said member for allowing movement between open and closed positions when a preselected combination has been entered by a user.

Preferably said security system is a lockable drawer system which includes a locking device on said drawer or said support means and an electrically operable release mechanism on the other of said drawer or said support means, said electrically operable release mechanism being disengaged from said locking device when said preselected combination has been entered. In one preferred embodiment said locking means includes a rotatable cam co-operating with a pin member mounted on said support means to be engaged by said cam member. Preferably said electrically operable release mechanism includes a solenoid-activated arm member which engages said cam.

In one practical embodiment said electronic combination lock includes a plurality of switches, the activation/de-activation of which must be in a predetermined manner.

In a further aspect of the present invention there may be provided a lockable drawer system including at least one drawer slidable between open and closed positions and adapted to engage a support means, said drawer or said support means including a rotatable cam having first and second slots therein, said first slot co-operating with a pin member affixed to the other of said drawer or said support means to co-operate with said first slot, a latch means within said drawer and adapted to engage said second slot and latch release means for releasing said latch means to enable said drawer to be opened.

Preferably said latch release means includes a lock cylinder to release said latch. In a preferred embodiment said latch release means is a solenoid. In an especially preferred embodiment said latch release means includes both said lock cylinder and said solenoid, both operable independently of each other.

In yet a further aspect of the present invention there may be provided an electrically operable release mechanism including a rotatable cam, said cam adapted to engage a pin member when in a first or locked position, said cam pivotally coupled to a resiliently biased pivotally mounted lever at one end of said lever, the other end of said lever being held by a plunger of a solenoid when in said first position and said lever moving to a second or release position when said solenoid is actuated to withdraw said plunger causing said cam to rotate and release said pin member under resilient bias.

In still yet a further aspect of the present invention there may be provided a spring-loaded opener for slidably mounted drawers including a block member constrained to move within the channel of said bracket member, said block member adapted to be secured to a drawer support allowing relative movement between said bracket member and said block member, a pin member mounted within said channel and passing through said block member, said pin member including first and second springs co-axially mounted thereover, said first spring located between said bracket member and one end face of said block member and said second spring constrained by said pin member and the other end face of said block member.

These and other objects and aspects of the present invention will be more fully described with reference to the preferred non-limitative embodiment shown in the accompanying drawings, in which.

Figure 1:
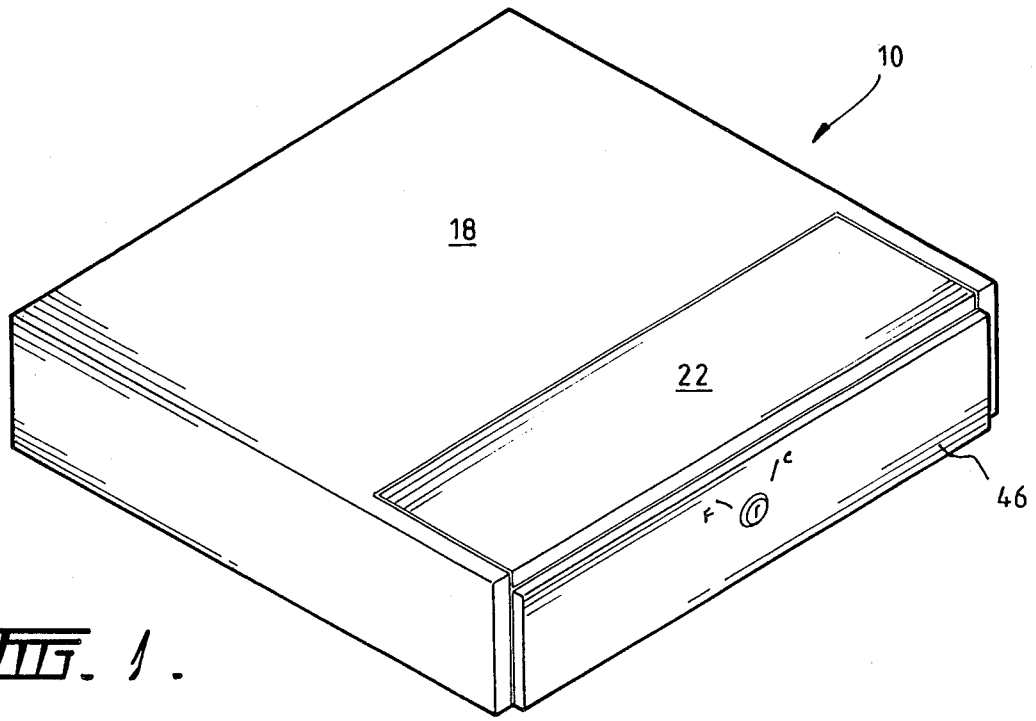
FIG. 1 is a perspective view of a first embodiment of a drawer system made in accordance with the invention.
Figure 2:
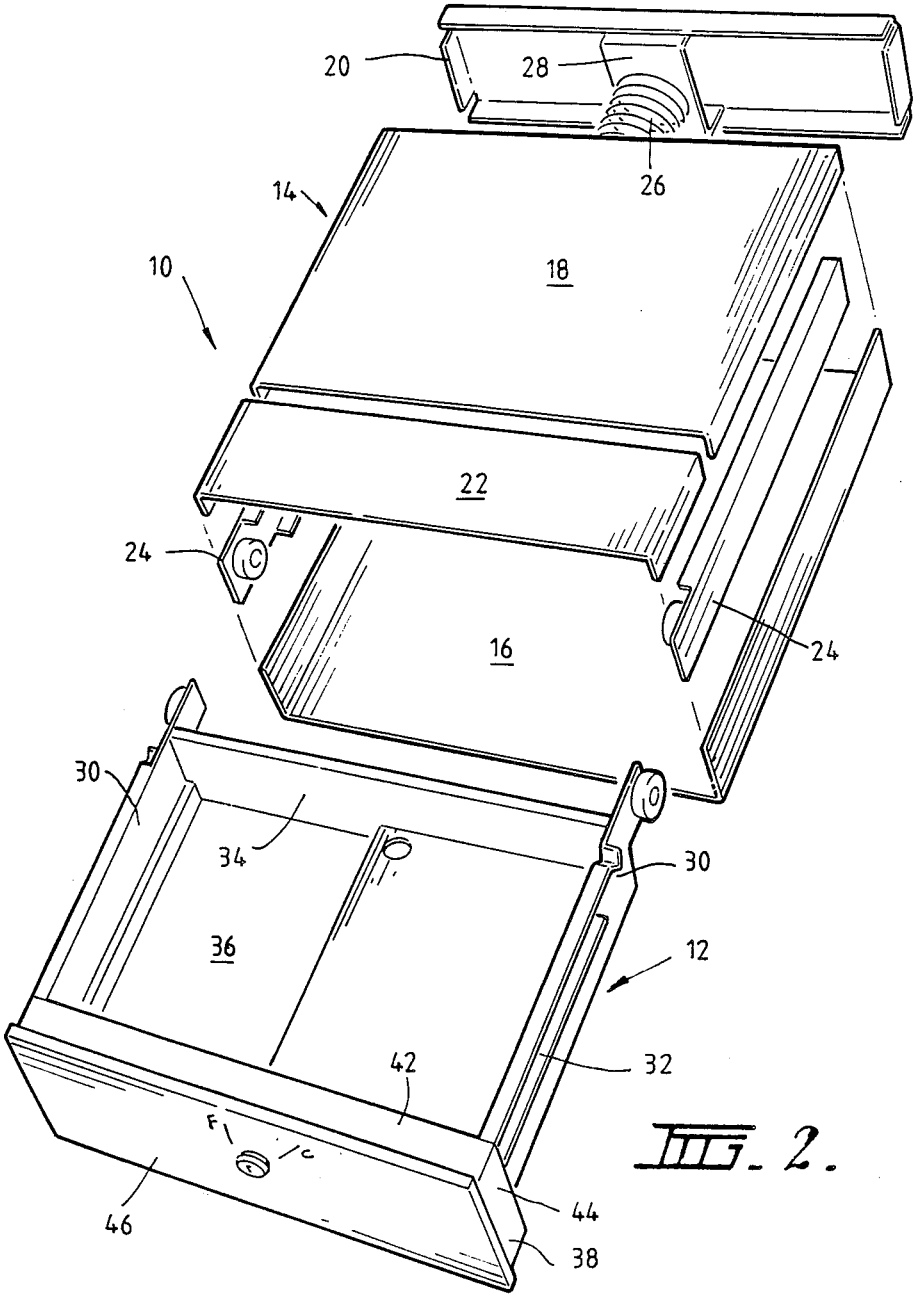
FIG. 2 is an exploded perspective view of the drawer system shown in FIG. 1.
Figure 3:
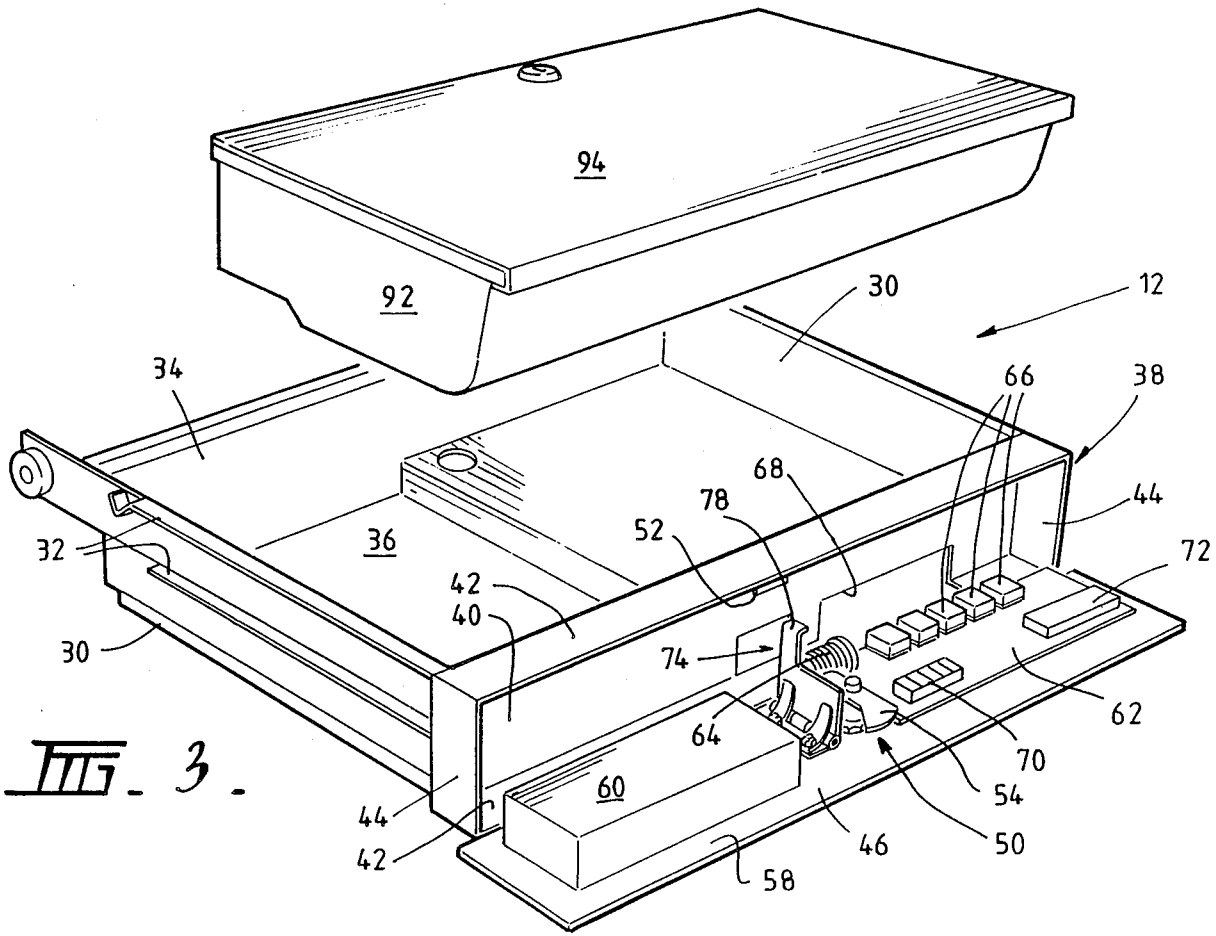
FIG. 3 is an exploded perspective view of the drawer an cash tray for the drawer system shown in FIG. 1 with the front fascia panel having been released.
Figure 4:
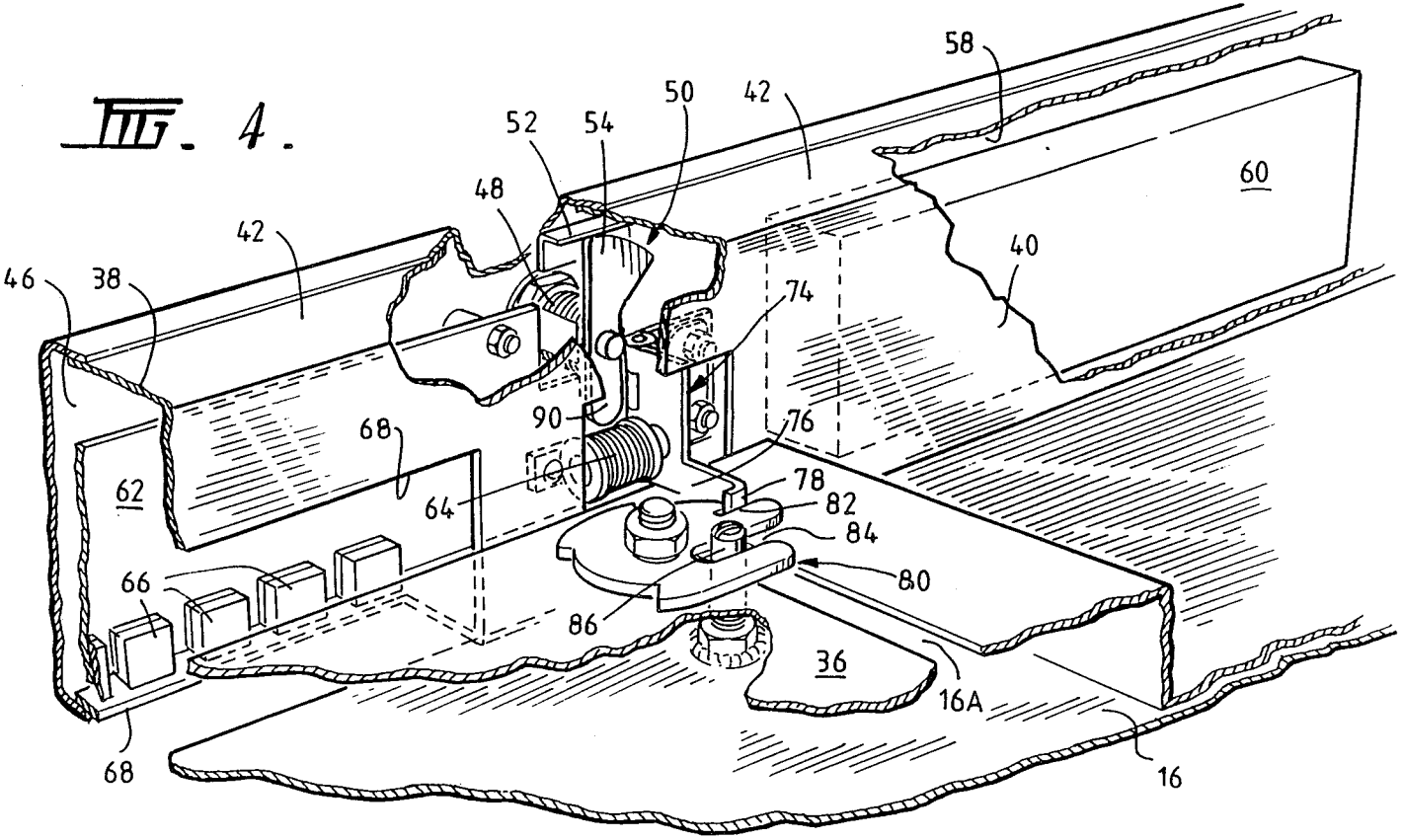
FIG. 4 is an enlarged perspective view of the locking means used in the drawer system shown in FIG. 1.
Figure 5:
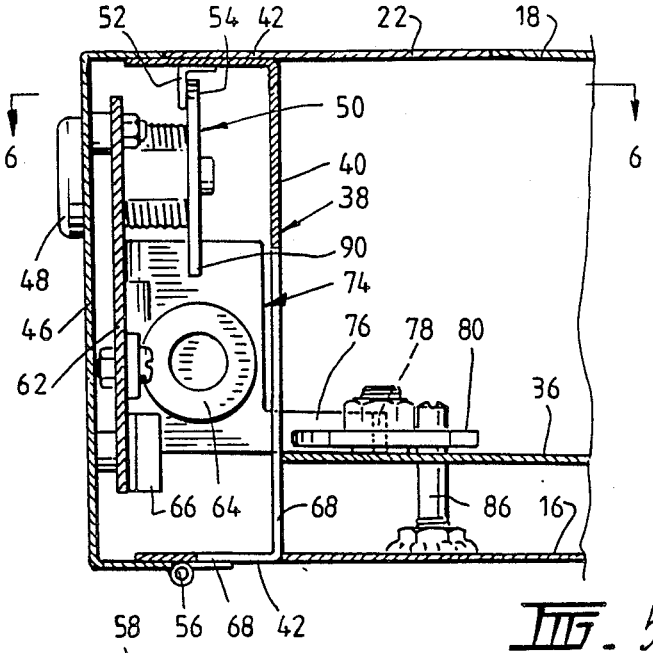
FIG. 5 is a cross-sectional view through the front of the draw system shown in FIG. 1.
Figure 6:
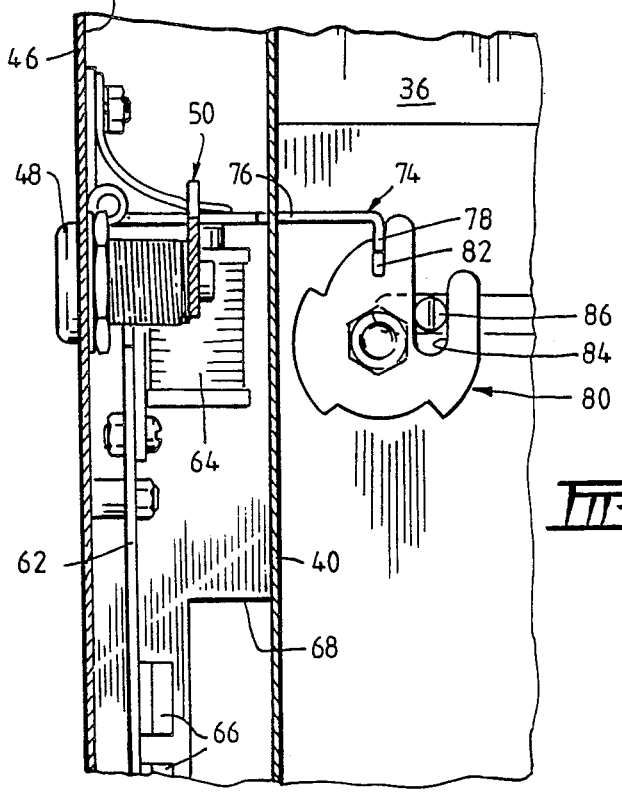
FIG. 6 is a cross-sectional view along and in the direction of arrows 6—6 shown in FIG. 5.

In the first embodiment shown in FIGS. 1 to 6 there is a cash drawer system 10 consisting of a drawer 12 and an enclosure 14. Enclosure 14 includes a bottom wrap 16 and a top wrap 18 which are secured together, e.g. by welding, to form a rectangular tubular sleeve. A rear panel 20 is also welded to wraps 16 and 18 to close off one end of enclosure 14. For decorative purposes an additional top wrap 22 is located at the front of enclosure 14. For guiding drawer 12 within enclosure 14 conventional runner tracks 24 are provided and these are welded to the inner sides of the enclosure. As this preferred embodiment is for a cash drawer system a spring 26 is secured to a bracket 28 in order that drawer 12 may be automatically ejected when opened.

Drawer 12 is a conventional drawer having sides 30 with co-operating runner spigots 32, an end wall 34 and floor 36. At the front of drawer 12 is a rectangular open ended box member 38 having a base 40 and upstanding side members 42 and end members 44. A front fascia panel 46 closes off box member 38 and is locked into position by locking arm 50 attached to lock cylinder 48. Locking arm 50 includes a first section 54 which, in the locked position, is located behind striker plate 52. Front fascia panel 46 is pivotally attached to bottom side member 42 by hinge 56.

On the inner face 58 of front fascia panel 46 is a battery pack 60, typically dry cells or rechargeable cells, for supplying electrical power to the electronics (not detailed). The electronics consists of a printed circuit board 62 and solenoid 64. In this embodiment five switches 66 are used to form an electronic combination lock. The switches 66 are mounted on printed circuit board 62 and are accessible to the user through a cut-out 68 in both the bottom side member 42 and base 40. The combination is selected by depressing only those switches that have been programmed to require depression to form the appropriate combination. The selection of the combination is by DIP switches 70 on printed circuit board 62. The electronics to decode switches 70 and monitor activation of switches 66 is elementary and familiar to the man skilled in the art. The electronics also monitors an alarm switch 72, e.g. reed switch, which activates an alarm if an attempted forced entry is made. Selection of the correct combination will activate solenoid 64 to allow drawer 12 to be opened.

On inner face 58 of front fascia panel 46 is mounted a spring-loaded latch 74 which is usually maintained in a right-angular orientation. At the free end of the pivoting section 76 of the latch is a tang 78. A rotatable cam 80 is mounted on floor 36 of drawer 12 and has a slot 82 for co-operation with tang 78. Cam 80 also has a further slot 84 which co-operates with a pin 86 secured to bottom wrap 16 and protruding through an aperture in floor 36. Thus in the "drawer closed" position shown in FIG. 4 to 6, drawer 12 cannot be opened as pin 86 is immobilized in slot 84 as tang 78 engages with slot 82 of cam 80. When the correct combination is selected, solenoid 64 will push against pivoting section 76 of latch 74 to release tang 78 from slot 82. Drawer 12 may be pulled forward causing cam 80 to be rotated in view of its coupling to pin 86. After a 90° rotation pin 86 will be free of slot 84. On shutting drawer 12, pin 86 will again be guided into slot 84 and cam 80 will be rotated to its initial position and tang 78 will be locked into slot 82.

The embodiment also allows keyed opening of drawer 12 through lock cylinder 48. As previously discussed anti-clockwise movement of the key (not shown) to position "F" (FIG. 2) will release front fascia panel 46 to allow the combination or batteries to be changed. By rotating the key clockwise to the "C" position a second section 90 of locking arm 50 will push against the pivoting section 76 of latch 74 to release tang 74 from slot 82. To complete the drawer a cash tray 92 can be inserted in drawer 12. Cash tray 92 can form the basis of a cash box by including a lockable lid 94 which is pivotally attached thereto.

It is clear from the above that the combination lock may have any number of switches 66 for selection of a particular combination. The use of five switches is very convenient as a smooth one handed operation results. The electronics also activates an alarm if an incorrect combination is entered. The alarm function of the drawer system will alert the owner to any attempt at pilfering. The switches 66 need not, if desired, be pressed simultaneously as entry of a sequential combination could also be used. The switches need not be on the drawer itself but could be positioned in any convenient location. If the drawer system were incorporated in a filing cabinet it would be inconvenient to have the "underneath" switch activated as in the illustrated embodiment. Accordingly the switches may be in the form of a key-pad e.g. touch-sensitive switches on the front of fascia panel 46.

In an alternative embodiment enclosure 14 may be omitted and drawer 12 may be slidably attached to a support member. This embodiment is suitable for a cash drawer which is affixed underneath a counter. The support member would be fastened to the underneath of the counter and the drawer would slide onto the support. The latch 74 would then co-operate with cam 80 at the top of the drawer rather than the bottom, as shown in the illustrated embodiment. If desired, the positions of cam 80 and pin 86 could be reversed with cam 80 being located on the support member.

In a further alternative embodiment locking arm 50 and spring-loaded latch 74 are omitted. The position and shape of cam 80 is changed together with the position of lock cylinder 48. In this embodiment lock 48 controls a shutter which, when open, exposes a fastening member which can be removed to allow access to the electronics. It is preferable to couple the shutter to a switch to cause actuation of the alarm when key operation is required. The fastening member preferably couples with a special tool for removing the fastening member. When the electronics are exposed a reset switch can be actuated to turn off the alarm. In this preferred embodiment the electrically operable release mechanism 100 shown in FIGS. 7 to 9 can be used. Release mechanism 100 may be mounted on the outer face of base 40 along with battery pack 60.

Release mechanism 100 includes a channel-shaped member 102 with a cut-out 104 to expose a cam 106 rotatably secured to channel-shaped member 102 by pin 114. Cam 106 has a slot 108 located between lobes 110 and 112. Movement of cam 106 is controlled by lever 116 which is pivotally secured to channel-shaped member 102 by pin 118. Lever 116 has a clawed end 120 which mates with a pin 122 on cam 106. A spring 124 is coupled to lever 116 and channel-shaped member 102 to bias lever 116 into the position shown in FIG. 8. Depending from channel-shaped member 102 is an angle bracket 124A on which is mounted a solenoid 126. Solenoid 126 includes a plunger 128 which is resiliently biased to its extreme position by spring 130 located between solenoid 126 and a pin 132 on plunger 128. Plunger 128 enters channel-shaped member 102 through an aperture therein. In the position shown in FIG. 8 lever 116 abuts the free end of plunger 128 to prevent plunger 128 from being fully extended under spring bias.

Figure 8:
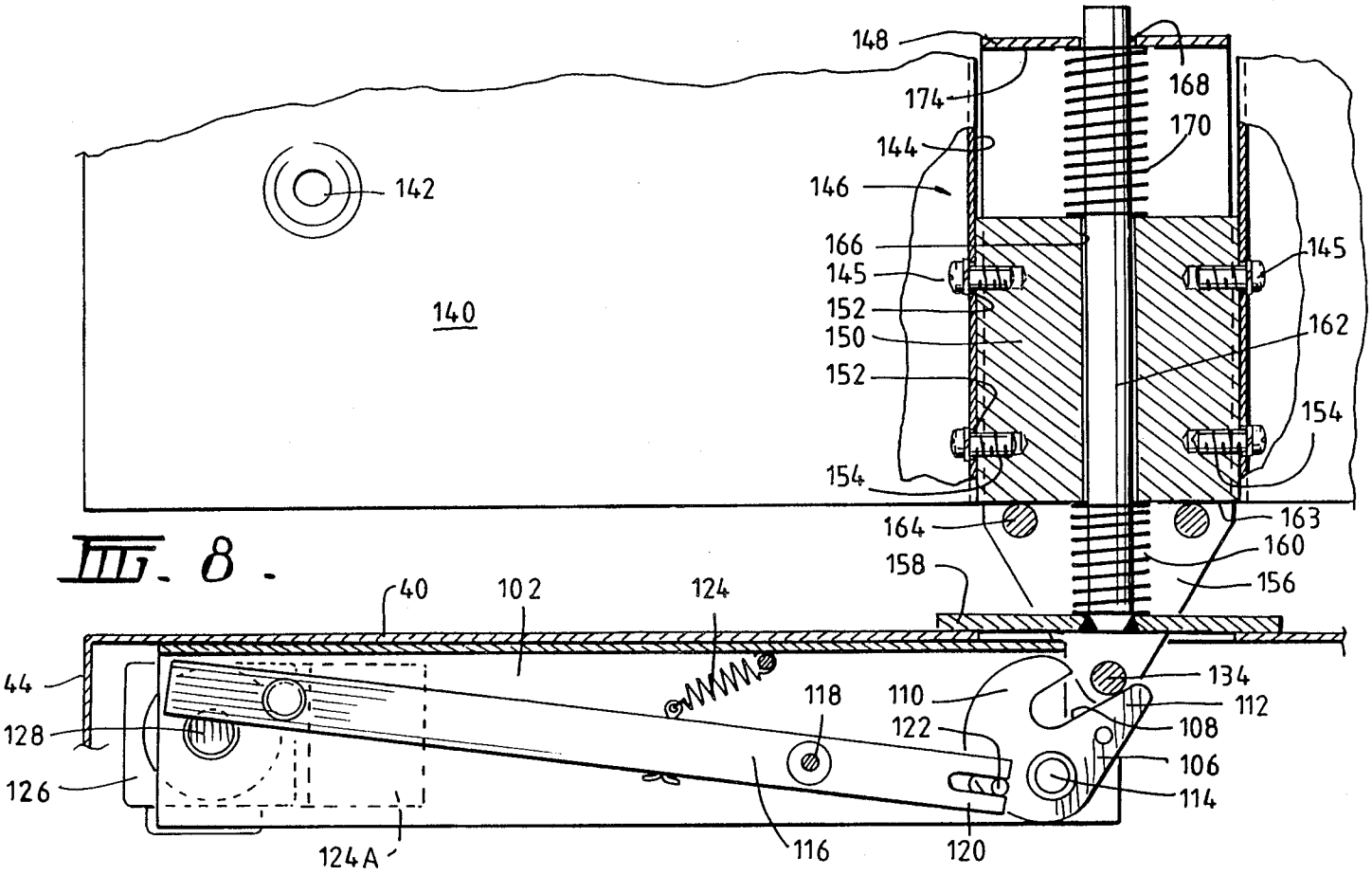
FIG. 8 is a plan side view in part section of the locking means shown in FIG. 7 with the drawer in the open position.
Figure 9:
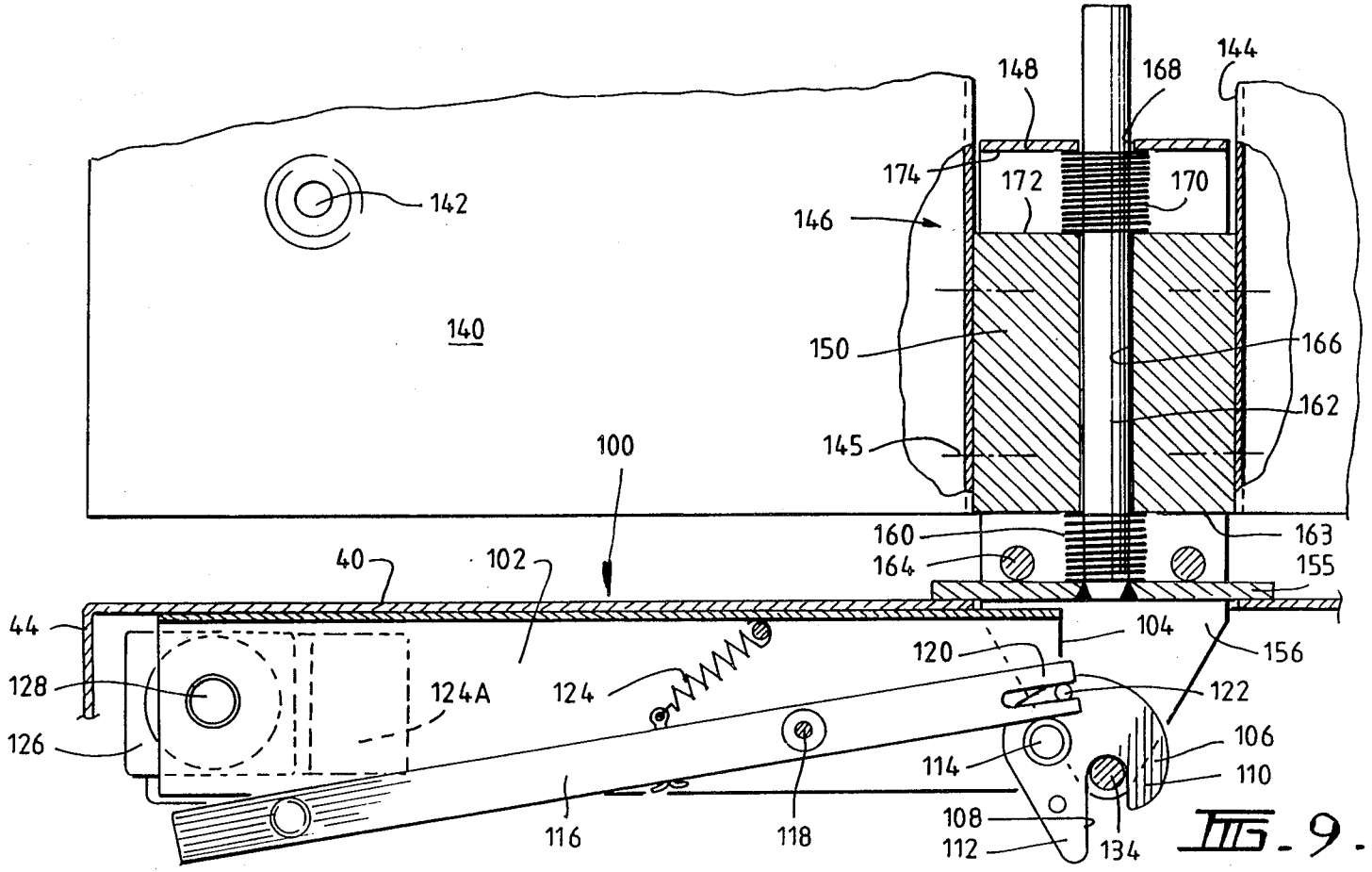
FIG. 9 is the same view as that of FIG. 8 with the drawer in the closed position.

In use, FIG. 8 shows the release mechanism 100 in the "drawer open" position. When closing the drawer lobe 112 will contact locking pin 134 located on the drawer support and force cam 106 to rotate clockwise until pin 134 is located in slot 108 between lobes 110 and 112. Simultaneously the free end of lever 116 will move anti-clockwise until plunger 128 is completely exposed. Plunger 128 will then move upwardly under the bias of spring 130 to prevent lever 116 from returning to its "drawer open" position. FIG. 9 shows that lever 116 is blocked by plunger 128 in the "drawer closed" position. With plunger 128 and locking pin 134 blocked the drawer cannot be opened. To open the drawer the correct combination must be entered whereby the electronics will actuate solenoid 126 to cause plunger 128 to be retracted. As lever 116 is no longer blocked by plunger 128 lever will move under the bias of spring 124 to the position shown in FIG. 8. Accordingly cam 106 will release locking pin 134 to allow the drawer to be opened. If required the drawer can be manually released by depressing washer 136 when access has been gained to the electronics.

Figure 7:
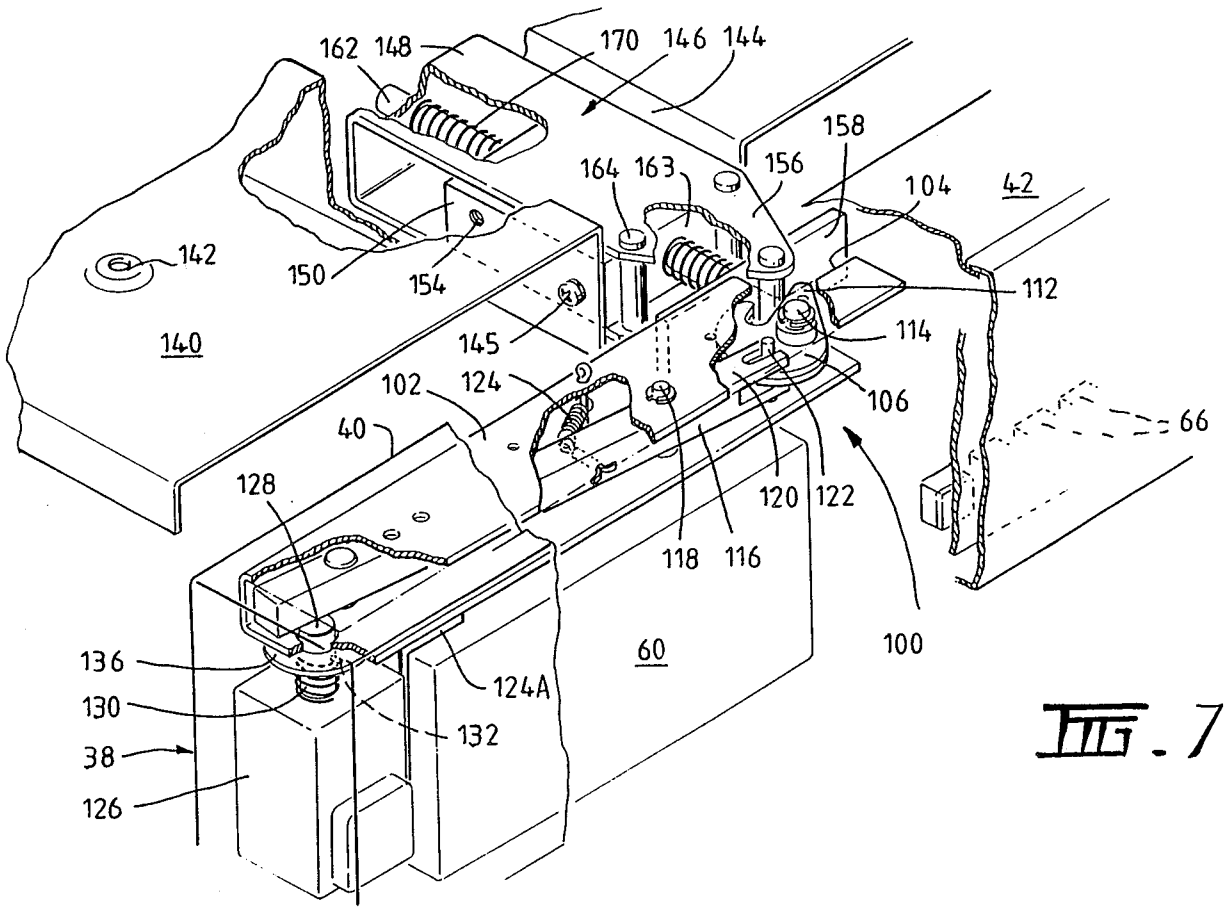
FIG. 7 is a perspective view of an alternate locking means for the drawer system shown in FIG. 1.

FIGS. 7, 8 and 9 also show an alternative form of biasing drawer 12 to its open position rather than using spring 26. In these figures a support member 140 is shown having a plurality of raised bosses 142 for securing underneath a counter or other frame member. A longitudinal channel 144 is formed in support member 140 for reception of a spring-loaded opener 146.

Spring-loaded opener 146 consists of a channel-shaped member 148 with a block member 150 slidably located therein. Block member 150 is fastened within channel 144 by fasteners 145 through apertures 152 in support member 140 and corresponding bores 154 in block member 150. Channel-shaped member 148 has a front angle nose portion 156 which includes locking pin 134. In the "drawer open" position a plate 158 abuts against locking pin 134 under the bias of spring 160. Spring 160 slides over slidable pin 162 which is coupled to plate 158 to be located between plate 158 and front face 163 of block member 150.

Channel-shaped member 148 has two limit stop pins 164 which restrict the relative forward movement between channel-shaped member 148 and block member 150. Pin 162 passes through bore 166 of block member 150 to emerge through aperture 168 of channel-shaped member 148. A further spring 170 is slid over pin 162 to be located between rear face 172 and the base section 174 of channel-shaped member 148.

In use, release mechanism 100 will move towards spring-loaded opener 146 when drawer 12 is closed. Plate 158 will abut channel-shaped member 102 and be pushed rearwardly away from locking pin 134. Locking pin 134 will co-operate with cam 106 as previously described. When the "drawer closed" position is reached plate 158 will be under stress from spring 160. On release of cam 106 plate 158 will be thrust forward under the spring bias to automatically open drawer 12.

Spring 170 allows drawer 12 to be pulled forward when locked to detect unauthorized entry thereto. If the drawer is pulled forward drawer 12 will move forward a small distance with channel-shaped member 148 moving therewith. As block member 150 is fastened to support member 140 it will not be moved resulting in compression of spring 170. A switch coupled to the electronics will be actuated on the relative movement between block member 150 and channel-shaped member 148 to set off the alarm. Spring 170 is much stronger than spring 160 and allows only a small amount of movement to occur. When the drawer is released spring 170 will return drawer to its normal position.

Although the preferred embodiments have been described with reference to a lockable drawer system it is clear that the invention is not restricted to such embodiments. The invention can be readily adapted to be used with sliding doors or lids, swinging doors or lids or removable lids as would be obvious to the man skilled in the art.

It is believed that the invention and many of its attendant advantages will be understood from the foregoing description and it will be apparent that various changes may be made in the form, construction and arrangement of the parts and that changes may be made in the form, construction and arrangement of the security system described without departing from the spirit and scope of the invention or sacrificing all of its material advantages, the form herein before described being merely a preferred embodiment thereof. The claims defining the invention are as follows:

I claim:

1. An electrically operable release mechanism including a longitudinal channel-shaped member with opposing faces, a rotatable cam located between said opposing faces, said cam adapted to engage a pin member when in a first or locked position, said cam pivotally coupled at one end of a resiliently biased pivotally mounted lever located between said opposing faces, the other end of said lever being held by a plunger of a solenoid when in said first position, the plunger entering the channel-shaped member through an aperture in one of said faces and said lever moving to a second or release position when said solenoid is actuated to withdraw said plunger causing said cam to rotate and release said pin member under resilient bias.

2. A lockable security system including at least one member movable between open and closed positions and adapted to engage a support means and an electronic combination lock adapted to be connected, directly or indirectly, to said member for allowing movement of said member between said open and closed positions when a preselected combination has been entered by a user, said electronic combination locking including an electrically operable release mechanism comprising a rotatable cam located between opposing faces of a longitudinal channel-shaped member, said cam adapted to engage a pin member on said support means when in a first or locked position, said cam pivotally coupled at one end of a resiliently biased pivotally mounted lever located between said opposing faces of said longitudinal channel-shaped member, the other end of said lever when in said first position, being held by a plunger of a solenoid entering the longitudinal channel-shaped member through an aperture in one of said opposing faces and said lever moving to a second or release position when said solenoid is actuated to withdraw said plunger causing said cam to rotate and release said pin member under resilient bias.

3. The security system of claim 2, further including a spring-loaded opener for said drawer including a block member constrained to move within a channel of a bracket member, said block member adapted to be secured to a drawer support allowing relative movement between said bracket member and said block member, a plunger mounted within said channel and passing through said block member, said plunger including first and second springs co-axially mounted thereover, said first spring located between said bracket member and one end face of said block member and said second spring constrained by a plate member on said plunger and the other end face of said block member, said plate member adapted to abut said pin member on said bracket.

4. The security system of claim 2, wherein said security system is a lockable drawer system with the drawer containing said electrically operable release mechanism.

5. A spring-loaded opener for slidably mounted drawers including a block member constrained to move within a channel of a bracket member, said block member adapted to be secured to a drawer support allowing relative movement between said bracket member and said block member, a pin member mounted within said channel and passing through said block member, said pin member including first and second springs co-axially mounted thereover, said first spring located between said bracket member and one end face of said block member and said second spring constrained by said pin member and the other end face of said block member.

* * * * *